US010597965B2

(12) United States Patent
Allen

(10) Patent No.: US 10,597,965 B2
(45) Date of Patent: Mar. 24, 2020

(54) DOWNHOLE TOOLS HAVING CONTROLLED DEGRADATION

(71) Applicant: Ryan Allen, Cypress, TX (US)

(72) Inventor: Ryan Allen, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/456,752

(22) Filed: Mar. 13, 2017

(65) Prior Publication Data

US 2018/0258722 A1 Sep. 13, 2018

(51) Int. Cl.

| | |
|---|---|
| ***E21B 27/00*** | (2006.01) |
| ***E21B 29/02*** | (2006.01) |
| ***E21B 33/1295*** | (2006.01) |

(52) U.S. Cl.

CPC ..... *E21B 29/02* (2013.01); *E21B 27/00* (2013.01); *E21B 33/12955* (2013.01)

(58) Field of Classification Search

CPC ..... E21B 29/02

See application file for complete search history.

(56) References Cited

U.S. PATENT DOCUMENTS

| | | | | |
|---|---|---|---|---|
| 5,990,051 | A | 11/1999 | Ischy et al. | |
| 8,528,633 | B2 | 9/2013 | Agrawal et al. | |
| 9,101,978 | B2 | 8/2015 | Xu et al. | |
| 2007/0107908 | A1* | 5/2007 | Vaidya | E21B 34/14 166/376 |
| 2009/0078408 | A1 | 3/2009 | Richard et al. | |
| 2012/0181020 | A1* | 7/2012 | Barron | B01J 13/02 166/250.1 |
| 2013/0081815 | A1 | 4/2013 | Mazyar et al. | |
| 2014/0196899 | A1 | 7/2014 | Jordan et al. | |
| 2015/0159462 | A1* | 6/2015 | Cutler | E21B 33/12 166/377 |
| 2015/0239795 | A1 | 8/2015 | Doud et al. | |
| 2016/0130906 | A1 | 5/2016 | Garvey et al. | |
| 2016/0201427 | A1 | 7/2016 | Fripp et al. | |
| 2016/0230494 | A1 | 8/2016 | Fripp et al. | |
| 2018/0230769 | A1 | 8/2018 | Xu et al. | |

OTHER PUBLICATIONS

International Search Report, International Application No. PCT/US2018/018142, dated May 17, 2018, Korean Intellectual Property Office; International Search Report 4 pages.

International Written Opinion, International Application No. PCT/US2018/018142, dated May 17, 2018, Korean Intellectual Property Office; International Written Opinion 8 pages.

Binauld et al. "Acid-degradable polymers for drug delivery: a decade of innovation", Chem. Commun., 2013, 49; pp. 2082-2102.

U.S. Appl. No. 15/429,761, filed Feb. 10, 2017, Entitled: Downhole Tools Having Controlled Disintegration and Applications Thereof, First Named Inventor: YingQing Xu.

* cited by examiner

*Primary Examiner* — David J Bagnell
*Assistant Examiner* — Dany E Akakpo
(74) *Attorney, Agent, or Firm* — Cantor Colburn LLP

(57) ABSTRACT

A method of controllably disintegrating a downhole article comprises disposing the downhole article in a downhole environment, the downhole article containing a matrix material; a first chemical; and a second chemical physically isolated from the first chemical, and allowing the first chemical to contact and react with the second chemical generating an acid, a salt, heat, or a combination comprising at least one of the foregoing that accelerates the degradation of the matrix material in a downhole fluid.

11 Claims, 5 Drawing Sheets

DOWNHOLE TOOLS HAVING CONTROLLED DEGRADATION

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating downhole tools have been developed. Instead of milling or drilling operations, these tools can be removed by dissolution of engineering materials using various wellbore fluids. One challenge for the self-disintegrating downhole tools is that the disintegration process can start as soon as the conditions in the well allow the corrosion reaction of the engineering material to start. Thus the disintegration period is not controllable as it is desired by the users but rather ruled by the well conditions and product properties. Currently, disintegrating fracturing plugs require thorough planning and application based research to determine if the technology is a good fit for each individual well. Therefore, having a known disintegration time that is independent of reservoir characteristics is very valuable to oil and gas operators. Accordingly the development of downhole tools that have minimal or no disintegration during the service of the tools so that they have the mechanical properties necessary to perform their intended function and then rapidly disintegrate is very desirable.

BRIEF DESCRIPTION

A method of controllably disintegrating a downhole article comprises disposing the downhole article in a downhole environment, the downhole article containing a matrix material; a first chemical; and a second chemical physically isolated from the first chemical, and allowing the first chemical to contact and react with the second chemical generating an acid, a salt, heat, or a combination comprising at least one of the foregoing that accelerates the degradation of the matrix material in a downhole fluid.

A downhole article comprises a matrix material; a first chemical; and a second chemical physically isolated from the first chemical, wherein the first chemical reacts with the second chemical when combined generating an acid, a salt, heat, or a combination comprising at least one of the foregoing that accelerates the degradation of the matrix material in a downhole fluid.

BRIEF DESCRIPTION OF THE DRAWINGS

The following descriptions should not be considered limiting in any way. With reference to the accompanying drawings, like elements are numbered alike.

DETAILED DESCRIPTION

The disclosure provides methods that are effective to delay or reduce the disintegration of various downhole tools during the service of the tools but can accelerate the disintegration process of the tools after the tools are no longer needed. The disclosure also provides downhole articles having a controlled disintegration profile.

The downhole article comprises a matrix material; a first chemical; and a second chemical physically isolated from the first chemical. The matrix material is selected such that the article has minimal or controlled corrosion in a downhole environment. In a specific embodiment, the downhole article has a corrosion rate of less than about 100 $mg/cm^2$/hour, less than about 10 $mg/cm^2$/hour, or less than about 1 $mg/cm^2$/hour determined in aqueous 3 wt. % KCl solution at 200° F. (93° C.). The first chemical and second chemical are selected such that when the first chemical is contacted with the second chemical, they react with each other generating an acid, a salt, heat, or a combination comprising at least one of the foregoing that accelerates the degradation of the matrix material in a downhole fluid.

Figure 1:
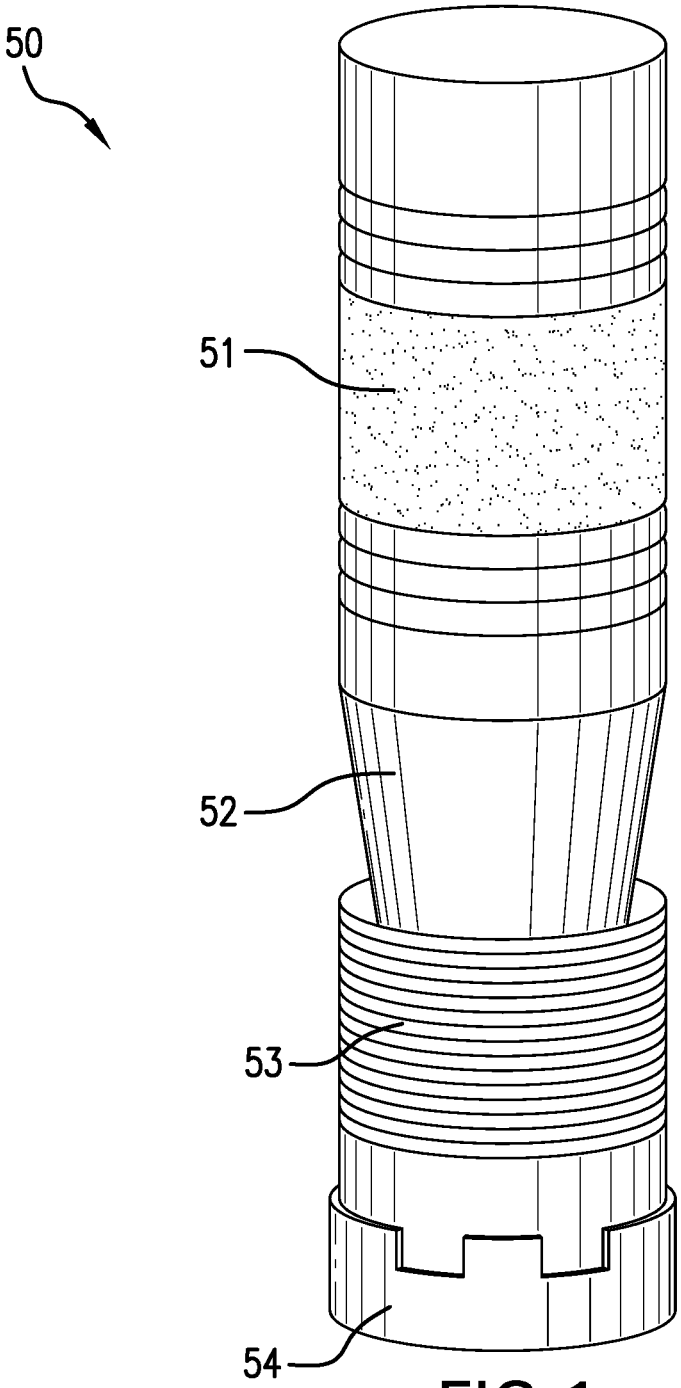
FIG. 1 is a schematic diagram of an exemplary downhole article according to an embodiment of the disclosure.

FIG. 1 shows a downhole article 50, such as a bridge plug, a frac plug, or any other suitable downhole article, for use in downhole operations. In an exemplary embodiment, the downhole article 50 includes a sealing member 51, a frustoconical member 52 (also referred to as a cone), a slip segment 53, and a bottom sub 54. The frustoconical member 52, the sealing member 51, the slip segment 53, and the bottom sub 54 can all be disposed about an annular body (not shown), which is a tubing, mandrel, or the like.

The downhole tool is configured to set (i.e., anchor) and seal to a structure such as a liner, casing, or closed or open hole in an earth formation borehole, for example, as is employable in hydrocarbon recovery and carbon dioxide sequestration applications.

During setting, article 50 is configured such that longitudinal movement of the frustoconical member 52 relative to the sealing member 51 causes the sealing member 51 to expand radially into sealing engagement with a structure. In addition, a pressure applied to the tool urges the sealing member 51 toward the slip segment 53 to thereby increase both sealing engagement of the sealing element 51 with the structure to be separated and the frustoconical element 52 as well as increasing the anchoring engagement of the slip segment 53 with the structure to be separated.

One or more of the sealing member 51, frustoconical member 52, a slip segment 53, and bottom sub 54 can comprise a matrix material. The matrix material comprises a metal, a composite, or a combination comprising at least one of the foregoing, which provides the general material properties such as strength, ductility, hardness, density for tool functions. As used herein, a metal includes metal alloys. The matrix material is corrodible in a downhole fluid. The downhole fluid comprises water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

Figure 2:
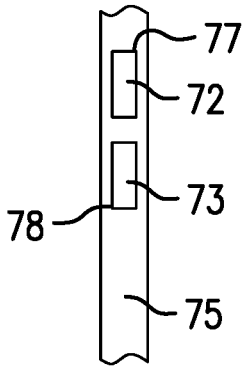
FIG. 2 is a schematic cross-sectional view of a portion of the exemplary downhole article of FIG. 1 having compartments that carry a first chemical and second chemical.

One or more of the sealing member 51, frustoconical member 52, a slip segment 53, and bottom sub 54 can carry the first chemical and the second chemical. The component that carries the first and second chemicals can have two separate but adjacent compartments as illustrated in FIG. 2. As shown in FIG. 2, the component that contains the first and second chemicals have two compartments 77 and 78 formed in the matrix material 75. First chemical 72 is disposed in compartment 77, and second chemical 73 is disposed in second compartment 78. Both the first chemical 72 and the second chemical 73 are inert to the matrix material 75, but can react to form a chemical, heat, or combination thereof that accelerates the degradation of the matrix material in a downhole fluid.

Figure 3:
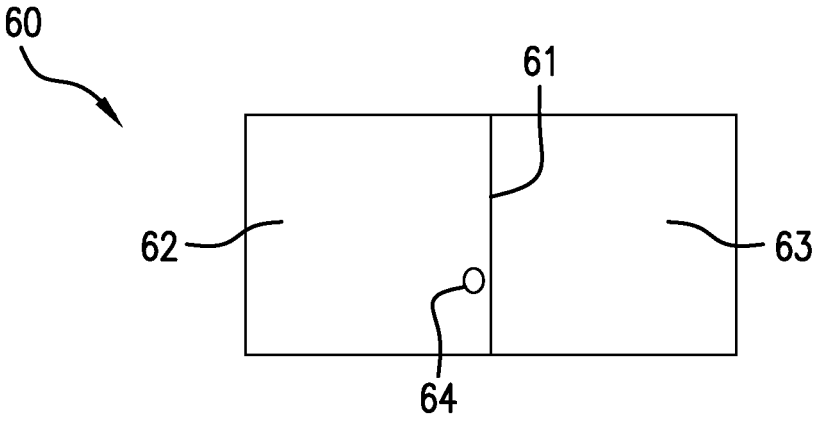
FIG. 3 is a schematic cross-sectional view of an exemplary container including a first chemical and a second chemical physically separated from the second chemical.

The first chemical and the second chemical can also be included in a container. An exemplary container is shown in FIG. 3. As shown in FIG. 3, container 60 has a divider 61 that separates the first chemical 62 from the second chemical 63. The shape of the container is not limited. Preferably the contained is a closed container. In a closed container, the physical form of the first and second chemicals is not limited. The first and second chemicals can be present in a solid, liquid, or gas form.

Figure 4:
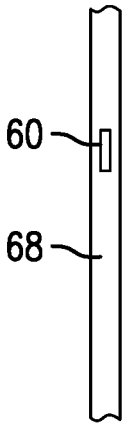
FIG. 4 is a schematic cross-sectional view of a portion of the exemplary downhole article of FIG. 1 having a container embedded therein according to an embodiment of the disclosure.

The container can be embedded in the matrix material. A schematic cross-sectional view of a portion of the exemplary downhole article having an embedded container is illustrated in FIG. 4. As shown in FIG. 4, a container 60 carrying the first and second chemicals are embedded in matrix material 68.

Figure 5:
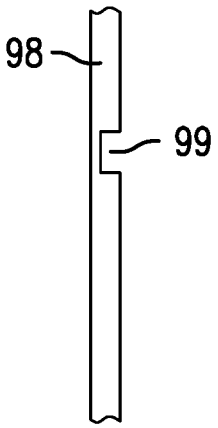
FIG. 5 is a schematic cross-sectional view of a portion of the exemplary downhole article of FIG. 1 having a concave according to an embodiment of the disclosure.

In another embodiment, the component that carries the first and second chemicals has a concave, and the container is disposed in the concave. As shown in FIG. 5, a concave 99 is formed in a matrix material 98. The position of the concave 99 is not particularly limited. A container including the first and second chemicals, such as the one shown in FIG. 3, can be disposed in concave 99. (not shown)

Figure 6:
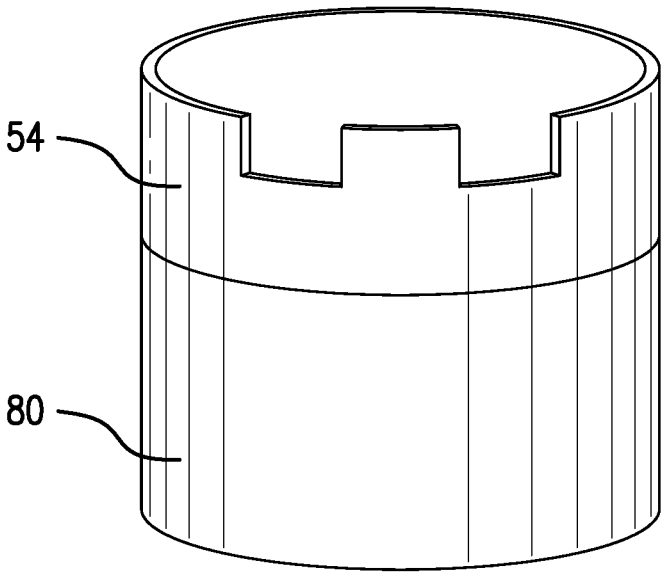
FIG. 6 is a schematic diagram of an exemplary bottom sub having a container attached thereto according to an embodiment of the disclosure.
Figure 7:
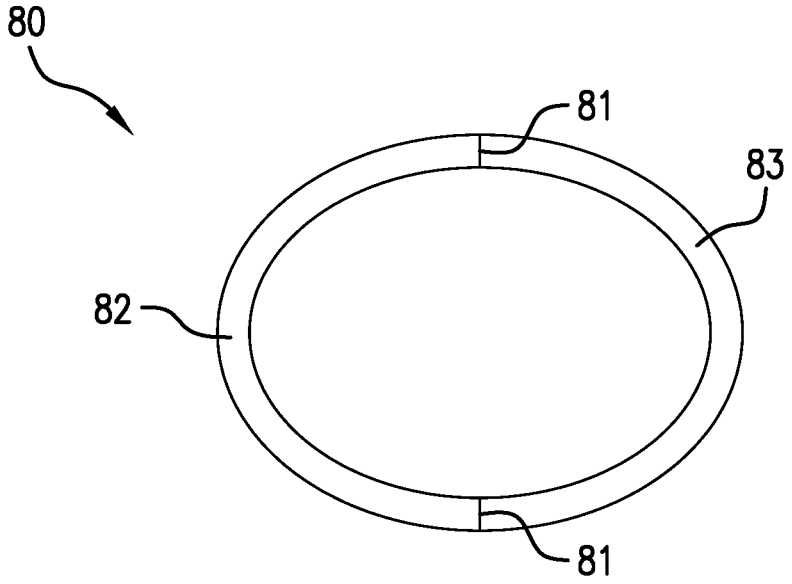
FIG. 7 is a schematic cross-sectional view of the container of FIG. 6 according to an embodiment of the disclosure.

Alternatively, the container is attached to the downhole article. FIG. 6 illustrates a container 80 that contains the first and second chemicals attached to bottom sub 54. The container 80 can also be disposed between two components of the article. In an exemplary embodiment, the container is disposed adjacent to a component formed of the matrix material. As shown in FIG. 7, an exemplary container 80 has dividers 81 that separate the first chemical 82 from the second chemical 83.

Optionally, the downhole article can further include an explosive device configured to disintegrate the compartments or the container that contain the first and second chemicals to cause them to come into contact with each other. The explosive device 64 can be disposed inside the compartments or the container. The explosive device can also be disposed at the vicinity of the compartments or the container.

In the methods disclosed herein, a downhole article or a downhole assembly containing the downhole article as described herein is disposed in a wellbore.

A downhole operation is then performed, which can be any operation that is performed during drilling, stimulation, completion, production, or remediation. A fracturing operation is specifically mentioned.

When the downhole article is no longer needed, the first chemical is allowed to react with the second chemical. The acid, salt, or heat, or a combination comprising at least one of the foregoing generated from the reaction accelerates the disintegration of the matrix material in the downhole fluid. As used herein, an acid includes a material that forms an acid when contacted with water, for example an anhydride. Exemplary salts include potassium bromide.

There are several ways to disintegrate the compartments and the containers or the dividers that separates the first and second chemicals. In an embodiment the method further comprises degrading the matrix material to expose the container or the compartments to the downhole fluid. Once the compartments are exposed, the first and second chemicals are released and allowed to react with each other. In the event that the first and second chemicals are included in a container, the exposed container can further degrade in the downhole fluid, thus releasing the first and second chemicals. The released first and second chemicals react and generate a chemical and/or heat that accelerates the degradation of the matrix material in the downhole fluid.

An explosive in the downhole article can also be used to disintegrate the compartments, the container, the divider, or both the container and the divider to allow the first chemical to contact and react with the second chemical.

The explosive device can be triggered by a timer, a signal received above the surface, a signal generated downhole, or a combination comprising at least one of the foregoing. The signal is not particularly limited and includes electromagnetic radiation, an acoustic signal, pressure, or a combination comprising at least one of the foregoing. When the signal is generated downhole, the article can further include a sensor that detects pressure, temperature, or the like in the local environment. Once a threshold value is satisfied, the sensor generates a signal which activates the explosive device. Upon the activation of the explosive device, the compartments, the container, and/or the divider is disintegrated allowing the first chemical to come into contact with the second chemical generating an acid, salt, heat, or a combination comprising at least one of the foregoing to accelerate the degradation of the matrix material in the downhole fluid.

The materials for the downhole articles are further described below. Exemplary matrix materials include zinc metal, magnesium metal, aluminum metal, manganese metal, an alloy thereof, or a combination comprising at least one of the foregoing. The matrix material can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

As used herein, a metal composite of the matrix material refers to a composite having a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the particle core material.

The material can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W, Cu, Fe, Si, Ca, Co, Ta, or Re. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978, the content of which is incorporated herein by reference in its entirety.

Optionally, the matrix material further comprises additives such as carbides, nitrides, oxides, precipitates, dispersoids, glasses, carbons, or the like in order to control the mechanical strength and density of the disintegrable article.

The container or divider can be formed of a metallic material. The metallic material can be the same material as described herein for the matrix material. Alternatively, the container or divider can be formed of a polymeric material. The polymeric material is degradable in a downhole fluid. Exemplary polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

Set forth below are various embodiments of the disclosure.

Embodiment 1

A method of controllably disintegrating a downhole article, the method comprising: disposing the downhole article in a downhole environment, the downhole article containing a matrix material; a first chemical; and a second chemical physically isolated from the first chemical, and allowing the first chemical to contact and react with the second chemical generating an acid, a salt, heat, or a combination comprising at least one of the foregoing that accelerates the degradation of the matrix material in a downhole fluid.

Embodiment 2

The method of Embodiment 1, wherein the downhole fluid comprises water, brine, acid, or a combination comprising at least one of the foregoing.

Embodiment 3

The method of Embodiment 1 or Embodiment 2, wherein the first chemical and the second chemical are included in a container, the container having a divider that separates the first chemical from the second chemical.

Embodiment 4

The method of Embodiment 3, further comprising disintegrating the container, the divider, or both to allow the first chemical to contact and react with the second chemical.

Embodiment 5

The method of Embodiment 4, further comprising activating an explosive device in the downhole article to disintegrate the container, the divider, or both to allow the first chemical to contact and react with the second chemical.

Embodiment 6

The method of Embodiment 5, wherein the explosive device is triggered by a timer, a signal received above the surface, or a signal generated downhole, or a combination comprising at least one of the foregoing.

Embodiment 7

The method of any one of Embodiments 3 to 6, further comprising degrading the container, the divider, or both in the downhole fluid to allow the first chemical to contact and react with the second chemical.

Embodiment 8

The method of Embodiment 7, further comprising degrading the matrix material to expose the container to the downhole fluid.

Embodiment 9

The method of any one of Embodiments 3 to 8, wherein the container is embedded in the matrix material.

Embodiment 10

The method of any one of Embodiments 3 to 8, wherein the downhole article has a concave, and the container is disposed in the concave.

Embodiment 11

The method of any one of Embodiments 3 to 8, wherein the container is attached to the downhole article.

Embodiment 12

The method of Embodiment 11, wherein the container is attached to a component formed of the matrix material.

Embodiment 13

The method of any one of Embodiments 1 to 12, wherein the matrix material comprises Zn, Mg, Al, Mn, an alloy thereof, or a combination comprising at least one of the foregoing.

Embodiment 14

The method of any one of Embodiments 3 to 13, wherein the container is formed of a metallic material comprising Zn, Mg, Al, Mn, an alloy thereof, or a combination comprising at least one of the foregoing.

Embodiment 15

The method of any one of Embodiments 3 to 13, wherein the container is formed of a polymeric material comprising a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

Embodiment 16

A downhole article comprising: a matrix material; a first chemical; and a second chemical physically isolated from the first chemical, wherein the first chemical reacts with the second chemical when combined generating an acid, a salt, heat, or a combination comprising at least one of the foregoing that accelerates the degradation of the matrix material in a downhole fluid.

Embodiment 17

The downhole article of Embodiment 16, further comprising a container including the first chemical and the second chemical, the container having a divider that separates the first chemical from the second chemical.

Embodiment 18

The downhole article of Embodiment 17, wherein the container is embedded in the matrix material.

Embodiment 19

The downhole article of Embodiment 17, wherein the downhole article has a concave, and the container is disposed in the concave.

Embodiment 20

The downhole article of Embodiment 17, wherein the container is attached to the downhole article.

Embodiment 21

The downhole article of Embodiment 17, wherein the downhole article has two separate and adjacent compartments formed in the matrix material, one compartment containing the first chemical and the other containing the second chemical.

Embodiment 22

The downhole article of any one of Embodiments 17 to 21, further comprising an explosive device configured to disintegrate the container, the divider, or both.

Embodiment 23

The downhole article of any one of Embodiments 17 to 21, wherein the container is formed of a metallic material comprising Zn, Mg, Al, Mn, an alloy thereof, or a combination comprising at least one of the foregoing, or the container is formed of a polymeric material comprising a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A method of controllably disintegrating a downhole article, the method comprising:

disposing the downhole article in a downhole environment, the downhole article containing a matrix material and a container embedded in the matrix material, the container having a divider that separates a first chemical and a second chemical included in the container;

degrading the matrix material with a downhole fluid to expose the container to the downhole fluid;

degrading the exposed container in the downhole fluid to release the first chemical and the second chemical from the container;

allowing the released first chemical to contact and react with the released second chemical generating an acid, a salt, heat, or a combination comprising at least one of the foregoing that accelerates the degradation of the matrix material in the downhole fluid, wherein the container is formed of a metallic material or a polymeric material, the metallic material comprising Zn metal, Mg metal, Al metal, Mn metal, an alloy thereof, or a combination comprising at least one of the foregoing; and the polymeric material comprising a polyethylene glycol, a polypropylene glycol, a polycaprolactone, a polydioxanone, a polyhydroxyalkanoate, a polyhydroxybutyrate, a copolymer thereof, or a combination comprising at least one of the foregoing.

2. The method of claim 1, wherein the downhole fluid comprises water, brine, acid, or a combination comprising at least one of the foregoing.

3. The method of claim 1, further comprising activating an explosive device in the downhole article to disintegrate the container, the divider, or both to allow the first chemical to contact and react with the second chemical.

4. The method of claim 3, wherein the explosive device is triggered by a timer, a signal received above the surface, or a signal generated downhole, or a combination comprising at least one of the foregoing.

5. The method of claim 1, wherein the downhole article has a concave, and the container is disposed in the concave.

6. The method of claim 1, wherein the matrix material comprises Zn, Mg, Al, Mn, an alloy thereof, or a combination comprising at least one of the foregoing.

7. The method of claim 1, wherein the container is formed of the metallic material.

8. The method of claim 1, wherein the container is formed of the polymeric material.

9. The method of claim 1, wherein the released first chemical is allowed to contact and react with the released second chemical generating an acid that accelerates the degradation of the matrix material in the downhole fluid.

10. The method of claim 1, wherein the released first chemical is allowed to contact and react with the released second chemical generating a salt that accelerates the degradation of the matrix material in the downhole fluid.

11. The method of claim 1, wherein the first chemical and the second chemical are inert to the matrix material.

* * * * *